US009957910B2

(12) United States Patent
Matsumoto

(10) Patent No.: US 9,957,910 B2
(45) Date of Patent: May 1, 2018

(54) DIAGNOSTIC SYSTEM AND DIAGNOSTIC METHOD FOR INTERNAL COMBUSTION ENGINE

(71) Applicant: Takashi Matsumoto, Okazaki (JP)

(72) Inventor: Takashi Matsumoto, Okazaki (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 65 days.

(21) Appl. No.: 14/404,396

(22) PCT Filed: Jul. 22, 2013

(86) PCT No.: PCT/IB2013/001579
§ 371 (c)(1),
(2) Date: Nov. 26, 2014

(87) PCT Pub. No.: WO2014/020393
PCT Pub. Date: Feb. 6, 2014

(65) Prior Publication Data

US 2015/0167575 A1 Jun. 18, 2015

(30) Foreign Application Priority Data

Aug. 1, 2012 (JP) ..... 2012-170872

(51) Int. Cl.
*F02D 41/30* (2006.01)
*F02D 41/26* (2006.01)
(Continued)

(52) U.S. Cl.
CPC ..... *F02D 41/26* (2013.01); *F02D 41/1495* (2013.01); *F02D 41/221* (2013.01);
(Continued)

(58) Field of Classification Search
CPC .... F02D 41/26; F02D 41/1495; F02D 41/221; F02D 41/3094; F02D 2200/1015;
(Continued)

(56) References Cited

U.S. PATENT DOCUMENTS 7,337,766 B2 * 3/2008 Nakayama ..... F02D 35/02 123/435
2005/0098154 A1 * 5/2005 Ohtani ..... F02D 41/1498 123/431
(Continued)

FOREIGN PATENT DOCUMENTS

DE 10 2006 041 406 A1 2/2010
JP 2008-14198 A 1/2008

*Primary Examiner* — Stephen K Cronin
*Assistant Examiner* — Gonzalo Laguarda
(74) *Attorney, Agent, or Firm* — Finnegan, Henderson, Farabow, Garrett & Dunner, LLP

(57) ABSTRACT

A diagnostic system for an engine includes: a plurality of cylinders, in-cylinder injectors, port injectors and an electronic control unit. The electronic control unit configured to make an abnormality diagnosis of an air-fuel ratio due to the in-cylinder injectors and then to make an abnormality diagnosis of the air-fuel ratio due to the port injectors. The electronic control unit is configured to make an abnormality diagnosis of the air-fuel ratio due to the in-cylinder injectors in an operating situation in which fuel is injected from only the in-cylinder injectors, and to make an abnormality diagnosis of the air-fuel ratio due to the port injectors by increasing a ratio of an injection amount of the port injectors when the electronic control unit has diagnosed that there is an abnormality of the air-fuel ratio in an operating situation in which fuel is injected from both the in-cylinder injectors and the port injectors.

6 Claims, 5 Drawing Sheets

(51) Int. Cl.
*F02D 41/14* (2006.01)
*F02D 41/22* (2006.01)

(52) U.S. Cl.
CPC .... *F02D 41/3094* (2013.01); *F02D 2041/224* (2013.01); *F02D 2200/1015* (2013.01)

(58) Field of Classification Search
CPC ..... F02D 2041/224; G01M 15/11; F02M 65/006; F02M 69/046
USPC ..... 123/479, 431; 701/107; 73/114.45
See application file for complete search history.

(56) References Cited

U.S. PATENT DOCUMENTS

| | | | | |
|---|---|---|---|---|
| 2009/0198434 | A1 | 8/2009 | Tanaka et al. | |
| 2010/0043746 | A1* | 2/2010 | Hartmann | F02D 19/0692 123/299 |
| 2011/0017176 | A1 | 1/2011 | Mizuno et al. | |
| 2012/0247422 | A1* | 10/2012 | Nagakura | F02D 41/1454 123/299 |

* cited by examiner

DIAGNOSTIC SYSTEM AND DIAGNOSTIC METHOD FOR INTERNAL COMBUSTION ENGINE

BACKGROUND OF THE INVENTION

1. Field of the Invention

The invention relates to a diagnostic system and diagnostic method for an internal combustion engine. Specifically, the invention relates to a technique for carrying out a diagnosis of a difference in air-fuel ratio among a plurality of cylinders in an internal combustion engine in which an injector that injects fuel inside a corresponding one of cylinders and an injector that injects fuel outside a corresponding one of the cylinders are provided in correspondence with each of the cylinders.

2. Description of Related Art

There is known an internal combustion engine in which an injector that injects fuel is provided in correspondence with each of a plurality of cylinders. In such an internal combustion engine, for example, if the injection amount of the injector becomes insufficient in only part of the cylinders, the air-fuel ratio of each of the part of the cylinders may deviate from the air-fuel ratio of the other one of the cylinders. When there is a difference in air-fuel ratio among the cylinders, rotation fluctuations of an output shaft of the internal combustion engine increase, so large vibrations may be generated. Thus, in order to be able to notify a user of an abnormality and to prompt the user for necessary repair, it is desired to detect the air-fuel ratio is not uniform.

Japanese Patent Application Publication No. 2008-14198 (JP 2008-14198 A) describes a technique for detecting an abnormality in a fuel injection system in an engine including a port injector that injects fuel into an intake port and a direct injector that directly injects fuel into a combustion chamber. JP 2008-14198 A describes the following abnormality diagnosis at paragraphs 21 to 25. That is, in the case where fuel is being injected in a distributed manner from the port injector and the direct injector, when a fluctuation amount of output torque is larger than a predetermined value, it is determined whether the direct injector is abnormal by injecting fuel with the use of only the direct injector. When it is determined that the direct injector is abnormal, fuel injection is switched to fuel injection with the use of only the port injector, and it is determined whether the port injector is abnormal on the basis of the fluctuation amount of output torque.

However, in JP 2008-14198 A, when the direct injector is normal, abnormality determination is not made in a state where fuel injection is carried out with the use of only the port injector. Thus, the accuracy of determination as to whether the port injector is abnormal may be low.

SUMMARY OF THE INVENTION

The invention provides a diagnostic system and diagnostic method that make an abnormality diagnosis of injectors with high accuracy.

A first aspect of the invention provides a diagnostic system for an internal combustion engine that includes a plurality of cylinders, in-cylinder injectors that respectively inject fuel inside the corresponding cylinders and port injectors that respectively inject fuel outside the corresponding cylinders. The diagnostic system includes an electronic control unit configured to make an abnormality diagnosis of an air-fuel ratio due to the in-cylinder injectors and then to make an abnormality diagnosis of the air-fuel ratio, due to the port injectors. The electronic control unit is configured to make an abnormality diagnosis of the air-fuel ratio due to the in-cylinder injectors in an operating situation in which fuel is injected from only the in-cylinder injectors, and the electronic control unit is configured to make an abnormality diagnosis of the air-fuel ratio due to the port injectors by increasing a ratio of an injection amount of the port injectors when the electronic control unit has made an abnormality diagnosis of the air-fuel ratio in an operating situation in which fuel is injected from both the in-cylinder injectors and the port injectors and then has diagnosed that there is an abnormality.

With the above configuration, an abnormality diagnosis of the air-fuel ratio due to the in-cylinder injectors is made in the operating situation in which fuel is injected from only the in-cylinder injectors, so it is possible to accurately make an abnormality diagnosis of the in-cylinder injectors. Furthermore, irrespective of whether there is an abnormality of the air-fuel ratio due to the in-cylinder injectors, after an abnormality diagnosis of the air-fuel ratio due to the in-cylinder injectors has been made, an abnormality diagnosis of the air-fuel ratio due to the port injectors is made. Thus, it is possible to individually make an abnormality diagnosis of the in-cylinder injectors and an abnormality diagnosis of the port injectors. The port injectors are subjected to abnormality diagnosis in not only the operating situation in which fuel is injected from both the in-cylinder injectors and the port injectors but also the operating situation in which the ratio of the injection amount of the port injectors is increased. Therefore, it is possible to make an abnormality diagnosis with high accuracy. Thus, it is possible to make an abnormality diagnosis of the in-cylinder injectors and an abnormality diagnosis of the port injectors with high accuracy.

In the diagnostic system, at the time when the electronic control unit makes an abnormality diagnosis of the air-fuel ratio due to the port injectors, the electronic control unit may be configured to make an abnormality diagnosis of the air-fuel ratio by increasing the ratio of the injection amount of the port injectors in the operating situation in which fuel is injected from both the in-cylinder injectors and the port injectors and, when the electronic control unit has diagnosed that there is an abnormality, make an abnormality diagnosis of the air-fuel ratio due to the port injectors by further increasing the ratio of the injection amount of the port injectors.

With the above configuration, at the time when the electronic control unit makes an abnormality diagnosis of the air-fuel ratio in the operating situation in which fuel is injected from both the in-cylinder injectors and the port injectors, the ratio of the injection amount of the port injectors is increased. Thus, it is possible to increase the influence of the port injectors on the air-fuel ratio. Therefore, it is possible to increase the accuracy of making an abnormality diagnosis of the air-fuel ratio due to the port injectors. In addition, the ratio of the injection amount of the port injectors is increased in a stepwise manner, so the ratio of the injection amount of the in-cylinder injectors is reduced in a stepwise manner. Therefore, at the time of making an abnormality diagnosis of the air-fuel ratio due to the port injectors, it is possible to make it difficult for a deposit to adhere to the in-cylinder injectors.

In the diagnostic system, at the time when the electronic control unit makes an abnormality diagnosis of the air-fuel ratio in the operating situation in which fuel is injected from both the in-cylinder injectors and the port injectors, the electronic control unit may be configured to change an amount of increase in the ratio of the injection amount of the port injectors on the basis of a result of an abnormality diagnosis of the air-fuel ratio due to the in-cylinder injectors.

With the above configuration, for example, when there is an abnormality of the air-fuel ratio due to the in-cylinder injectors, an abnormality diagnosis of the air-fuel ratio due to the port injectors is made by increasing the ratio of the injection amount of the port injectors as compared to when there is no abnormality. Thus, although a certain amount of deposit that adheres to the abnormal in-cylinder injectors is allowed, it is possible to reduce the influence of the in-cylinder injectors on abnormality diagnosis. Therefore, it is possible to make an abnormality diagnosis of the port injectors with high accuracy.

In the diagnostic system, when there is an abnormality of the air-fuel ratio due to the in-cylinder injectors, the electronic control unit may be configured to make an abnormality diagnosis of the air-fuel ratio due to the port injectors by increasing the ratio of the injection amount of the port injectors to 100%.

With the above configuration, for example, when there is an abnormality of the air-fuel ratio due to the in-cylinder injectors, although adhesion of a deposit to the abnormal in-cylinder injectors is allowed, it is possible to exclude the influence of the in-cylinder injectors on abnormality diagnosis. Therefore, it is possible to make an abnormality diagnosis of the port injectors with high accuracy.

In the diagnostic system, at the time when the electronic control unit makes an abnormality diagnosis of the air-fuel ratio in the operating situation in which fuel is injected from both the in-cylinder injectors and the port injectors, the electronic control unit may be configured to decrease a pressure of fuel that is injected from the in-cylinder injectors.

With the above configuration, by decreasing the pressure of fuel that is injected from the in-cylinder injectors, it is possible to reduce the fuel injection amount of the in-cylinder injectors while keeping the fuel injection duration of the in-cylinder injectors longer than a lower limit. It is possible to increase the ratio of the injection amount of the port injectors by increasing the fuel injection amount of the port injectors by the reduced fuel injection amount of the in-cylinder injectors. Therefore, in the operating situation in which fuel is injected from both the in-cylinder injectors and the port injectors as well, the diagnostic system is able to make an abnormality diagnosis of the port injectors with high accuracy by reducing the influence of the in-cylinder injectors on abnormality diagnosis.

In the diagnostic system, when the electronic control unit has diagnosed that there is an abnormality of the air-fuel ratio in the operating situation in which fuel is injected from both the in-cylinder injectors and the port injectors, the electronic control unit may be configured to increase the ratio of the injection amount of the port injectors to 100%.

With the above configuration, by making an abnormality diagnosis of the port injectors in the operating situation in which fuel is injected from only the port injectors, it is possible to exclude the influence of the in-cylinder injectors on abnormality diagnosis. Therefore, it is possible to make an abnormality diagnosis of the port injectors with high accuracy.

In the diagnostic system, when both an abnormality of the air-fuel ratio due to the in-cylinder injectors and an abnormality of the air-fuel ratio due to the port injectors have been detected, the electronic control unit may be configured to determine that there is an abnormality in distribution of air among the cylinders.

With the above configuration, when both the in-cylinder injectors and the port injectors are abnormal at the same time, an abnormality of an intake system may be presumed as a factor of an abnormality, other than the injection amount of fuel, so it is determined that there is an abnormality in distribution of air among the cylinders. Thus, it is possible to further accurately identify a cause of an abnormality.

A second aspect of the invention provides a diagnostic method for an internal combustion engine that includes a plurality of cylinders, in-cylinder injectors that respectively inject fuel inside the corresponding cylinders and port injectors that respectively inject fuel outside the corresponding cylinders. The diagnostic method includes: making an abnormality diagnosis of an air-fuel ratio due to the in-cylinder injectors in an operating situation in which fuel is injected from only the in-cylinder injectors; and, when an abnormality diagnosis of the air-fuel ratio has been made in an operating situation in which fuel is injected from both the in-cylinder injectors and the port injectors and then it has been diagnosed that there is an abnormality, making an abnormality diagnosis of the air-fuel ratio due to the port injectors by increasing a ratio of an injection amount of the port injectors.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
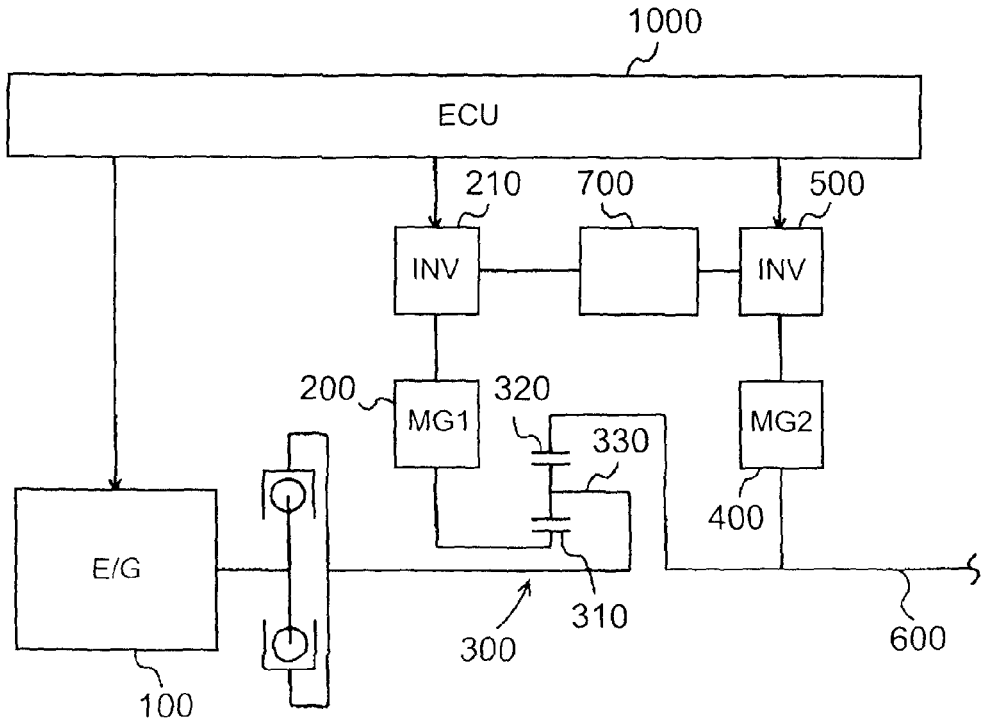
FIG. 1 is a schematic configuration view that shows a power train of a hybrid vehicle according to a first embodiment of the invention.

Hereinafter, embodiments of the invention will be described with reference to the accompanying drawings. In the following description, like reference numerals denote the like components. The names and functions of them are the same. Thus, the detailed description thereof is not repeated.

A power train of a hybrid vehicle on which a diagnostic system according to a first embodiment is mounted will be described with reference to FIG. 1. The diagnostic system according to the present embodiment is, for example, implemented by an electronic control unit (ECU) 1000.

As shown in FIG. 1, the power train is mainly formed of an engine 100, a first motor generator (MG1) 200, a power split mechanism 300 and a second motor generator (MG2) 400. The power split mechanism 300 combines or distributes torque between these engine 100 and first motor generator 200.

The engine 100 is a power unit that outputs power by burning fuel, and is configured to be able to electrically control an operating state, such as a throttle opening degree (intake air amount), a fuel supply amount and ignition timing. The control is, for example, executed by the ECU 1000 that is mainly formed of a microcomputer.

The first motor generator 200 is a three-phase alternating current rotating electrical machine as an example, and is configured to function as an electric motor and function as a generator. The first motor generator 200 is connected to an electrical storage device 700, such as a battery, via an inverter 210. The output torque or regenerative torque of the first motor generator 200 is appropriately set by controlling the inverter 210. The control is executed by the ECU 1000. A stator (not shown) of the first motor generator 200 is fixed, and does not rotate.

The power split mechanism 300 is a gear mechanism that provides differential action with the use of three rotating elements. The three rotating elements include a sun gear (S) 310, a ring gear (R) 320 and a carrier (C) 330. The sun gear (S) 310 is an external gear. The ring gear (R) 320 is an internal gear arranged concentrically with respect to the sun gear (S) 310. The carrier (C) 330 holds pinion gears such that the pinion gears are rotatable and revolvable. The pinion gears are in mesh with these sun gear (S) 310 and ring gear (R) 320. An output shaft of the engine 100 is coupled to the carrier (C) 330 via a damper. The carrier (C) 330 is a first rotating element. In other words, the carrier (C) 330 serves as an input element.

In contrast to this, a rotor (not shown) of the first motor generator 200 is coupled to the sun gear (S) 310 that is a second rotating element. Thus, the sun gear (S) 310 serves as a so-called reaction element, and the ring gear (R) 320 that is a third rotating element serves as an output element. The ring gear (R) 320 is coupled to an output shaft 600 coupled to a drive wheel (not shown).

Figure 2:
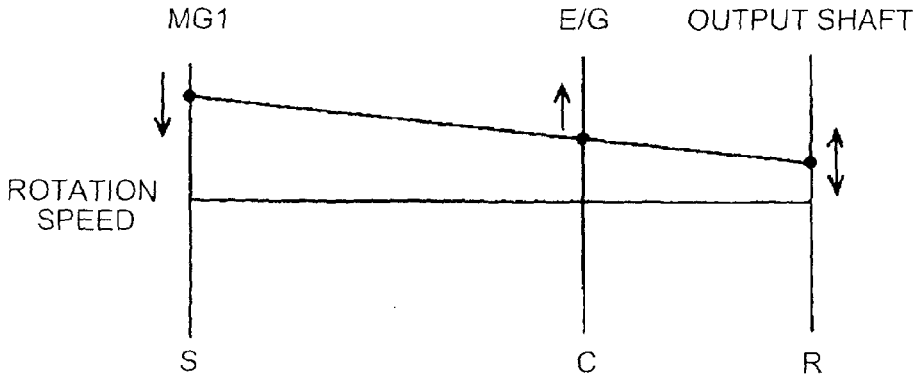
FIG. 2 is a nomograph of a power split mechanism in the first embodiment.

FIG. 2 shows a nomograph of the power split mechanism 300. As shown in FIG. 2, when reaction torque generated by the first motor generator 200 is input to the sun gear (S) 310 in addition to torque output from the engine 100 and input to the carrier (C) 330, torque having a magnitude obtained by adding or subtracting these torques appears in the ring gear (R) 320 that serves as the output element. In this case, the rotor of the first motor generator 200 rotates on that torque, and the first motor generator 200 functions as a generator. When the rotation speed (output rotation speed) of the ring gear (R) 320 is set constant, it is possible to continuously (steplessly) vary the rotation speed of the engine 100 by varying the rotation speed of the first motor generator 200. That is, it is possible to execute control for setting the rotation speed of the engine 100 to, for example, a rotation speed at which the fuel economy is the highest by controlling the first motor generator 200. The control is executed by the ECU 1000.

When the engine 100 is stopped while travelling, the first motor generator 200 rotates in reverse direction. In this state, when the first motor generator 200 is caused to function as an electric motor and output torque in a forward rotation direction, torque in a direction to cause the engine 100, coupled to the carrier (C) 330, to rotate in forward direction acts on the engine 100, so it is possible to start (motor or crank) the engine 100 with the use of the first motor generator 200. In this case, torque in a direction to stop the rotation of the output shaft 600 acts on the output shaft 600. Thus, it is possible to keep driving torque for propelling the vehicle by controlling torque that is output from the second motor generator 400, and it is possible to smoothly start the engine 100 at the same time. This hybrid type is called mechanical distribution type or split type.

Referring back to FIG. 1, the second motor generator 400 is a three-phase alternating-current rotating electrical machine as an example, and is configured to function as an electric motor and function as a generator. The second motor generator 400 is connected to the electrical storage device 700, such as a battery, via the inverter 500. Power running, regeneration and torque in the case of each of power running and regeneration are controlled by controlling the inverter 500. A stator (not shown) of the second motor generator 400 is fixed, and does not rotate. A rotor (not shown) of the second motor generator 400 is coupled to the output shaft 600.

Figure 3:
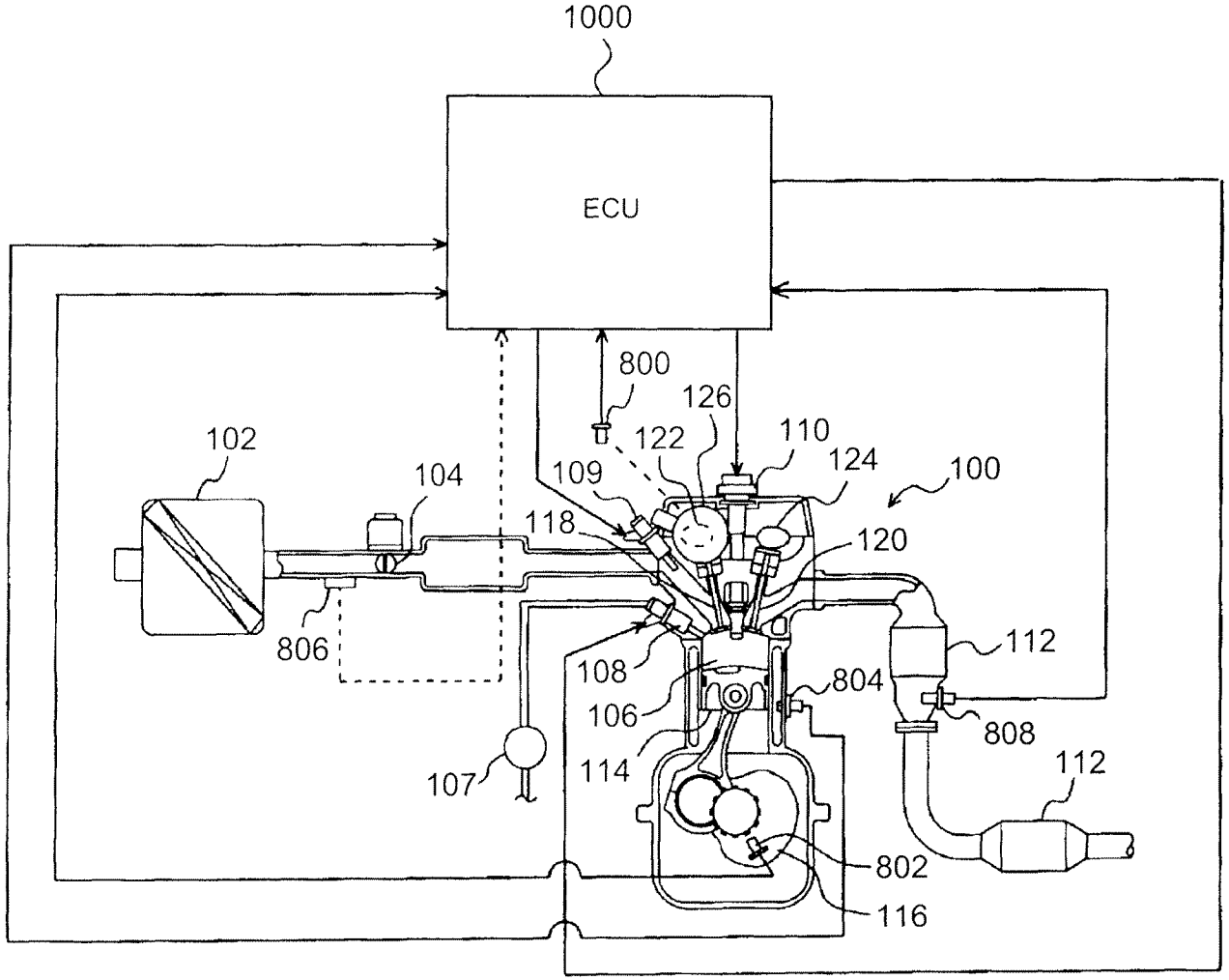
FIG. 3 is a schematic configuration view that shows an engine in the first embodiment.

The engine 100 will be further described with reference to FIG. 3. Air is taken into the engine 100 via an air cleaner 102. An intake air amount is adjusted by a throttle valve 104. The throttle valve 104 is an electronic throttle valve that is driven by a motor.

The engine 100 includes a plurality of cylinders 106. Air is mixed with fuel in each of the cylinders 106. Fuel is directly injected from each in-cylinder injector 108 into a corresponding one of the cylinders 106. That is, an injection hole of each in-cylinder injector 108 is provided inside a corresponding one of the cylinders 106, and the in-cylinder injector 108 injects fuel inside the corresponding cylinder 106. Fuel is supplied from a high-pressure fuel pump 107 to the in-cylinder injectors 108.

The high-pressure fuel pump 107 further pressurizes fuel fed from a low-pressure fuel pump (not shown) in a fuel tank (not shown), and supplies the fuel to the in-cylinder injectors 108. The high-pressure fuel pump 107 is configured to be able to vary the pressure of fuel to be discharged. The high-pressure fuel pump 107 may be a known pump, so the detailed description is not repeated here.

A port injector 109 is provided in correspondence with each of the cylinders 106 in addition to the in-cylinder injector 108. Each port injector 109 specifically injects fuel into an intake port outside a corresponding one of the cylinders 106. The in-cylinder injector 108 and the port injector 109 are provided in correspondence with each of the cylinders 106. For example, a pair of the in-cylinder injector 108 and the port injector 109 are provided in correspondence with each of the cylinders 106. The number of the in-cylinder injectors 108 and the number of the port injectors 109 are not limited to these numbers.

The ratio (DI ratio) r of an injection amount of the in-cylinder injectors 108 with respect to a total injection amount, that is, the ratio between an injection amount of the in-cylinder injectors 108 and an injection amount of the port injectors 109, is determined in accordance with a map predetermined by a developer using an engine rotation speed, a load, and the like, as parameters. A value obtained by multiplying the determined DI ratio r by a total fuel injection amount Q becomes an injection amount of the in-cylinder injectors 108, and a remaining amount of fuel is injected from the port injectors 109.

Thus, when the DI ratio r is indicated by the range of 0 to 1, the injection amount QD of the in-cylinder injectors 108 is obtained by multiplying the total injection amount Q by the DI ratio r. In addition, the injection amount QP of the port injectors 109 is obtained by multiplying the total injection amount Q by (1−DI ratio r). A method of determining the injection amount of fuel is not limited to this method.

An air-fuel mixture in each cylinder 106 is ignited by a corresponding ignition plug 110, and is burned. A burned air-fuel mixture, that is, exhaust gas, is purified by a three-way catalyst 112, and is then emitted to the outside of the vehicle. A piston 114 is pushed downward through burning of the air-fuel mixture, and a crankshaft 116 rotates.

An intake valve 118 and an exhaust valve 120 are provided at a head of each cylinder 106. The amount of air that is introduced into each cylinder 106 and the introduced timing are controlled by a corresponding one of the intake valves 118. The amount of exhaust gas that is emitted from each cylinder 106 and the emitted timing are controlled by a corresponding one of the exhaust valves 120. Each intake valve 118 is driven by a cam 122. Each exhaust valve 120 is driven by a cam 124.

The open/close timings (phases) of each intake valve 118 are changed by a variable valve timing mechanism 126. The open/close timings of each exhaust valve 120 may also be changed.

In the present embodiment, the open/close timings of each intake valve 118 are controlled by rotating a camshaft (not shown) having the cams 122 with the use of the variable valve timing mechanism 126. A method of controlling the open/close timings is not limited to this configuration. In the present embodiment, the variable valve timing mechanism 126 operates on hydraulic pressure.

The engine 100 is controlled by the ECU 1000. The ECU 1000 controls the throttle opening degree, the ignition timing, the fuel injection timing, the fuel injection amount and the open/close timings of each intake valve 118 such that the engine 100 is placed in a desired operating state. Signals are input from a cam angle sensor 800, a crank angle sensor 802, a coolant temperature sensor 804, an air flow meter 806 and an air-fuel ratio sensor 808 to the ECU 1000.

The cam angle sensor 800 outputs a signal that indicates a cam position. The crank angle sensor 802 outputs a signal that indicates the rotation speed (engine rotation speed) NE of the crankshaft 116 and the rotation angle of the crankshaft 116. The coolant temperature sensor 804 outputs a signal that indicates the temperature of coolant (hereinafter, referred to as coolant temperature) of the engine 100. The air flow meter 806 outputs a signal that indicates the amount of air that is taken into the engine 100. The air-fuel ratio sensor 808 detects the air-fuel ratio on the basis of an oxygen concentration in exhaust gas. An $O_2$ sensor may be used as the air-fuel ratio sensor 808.

The ECU 1000 controls the engine 100 on the basis of the signals input from these sensors and a map and a program stored in a memory.

Furthermore, the ECU 1000 detects an imbalance abnormality that there is an imbalance in air-fuel ratio among the plurality of cylinders 106. In the present embodiment, the ECU 1000 determines whether there is a difference in air-fuel ratio among the plurality of cylinders on the basis of a fluctuation amount of the engine rotation speed in order to detect an imbalance abnormality.

Figure 4:
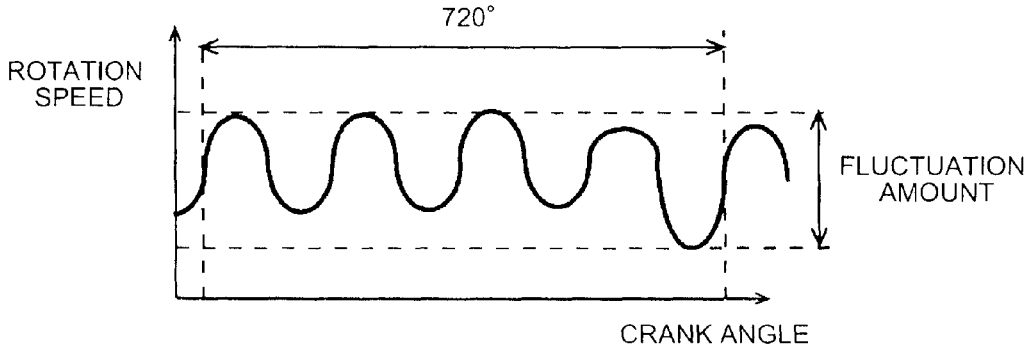
FIG. 4 is a graph that shows a state where an air-fuel ratio fluctuates in the first embodiment.

As an example, when the fluctuation amount of the engine rotation speed is larger than or equal to a threshold, it is determined that there is a difference in air-fuel ratio among the plurality of cylinders. As shown in FIG. 4, the fluctuation amount is, for example, obtained as a difference between, the maximum value and minimum value of the engine rotation speed in a period of a predetermined crank angle (for example, 720°). A general technique may be utilized as a method of detecting an imbalance abnormality of the air-fuel ratio due to rotation fluctuations, so the detailed description thereof is not repeated here. Other than the above, an imbalance abnormality may be detected on the basis of fluctuations in the air-fuel ratio detected by the air-fuel ratio sensor 808.

In the present embodiment, by separately making an imbalance abnormality diagnosis of the in-cylinder injectors 108 and an imbalance abnormality diagnosis of the port injectors 109, an abnormality diagnosis of the air-fuel ratio due to the in-cylinder injectors 108 and an abnormality diagnosis of the air-fuel ratio due to the port injectors 109 are individually made. When both an abnormality of the air-fuel ratio due to the in-cylinder injectors 108 and an abnormality of the air-fuel ratio due to the port injectors 109 have been detected, it is diagnosed that distribution of air among the cylinders is abnormal.

Figure 5:
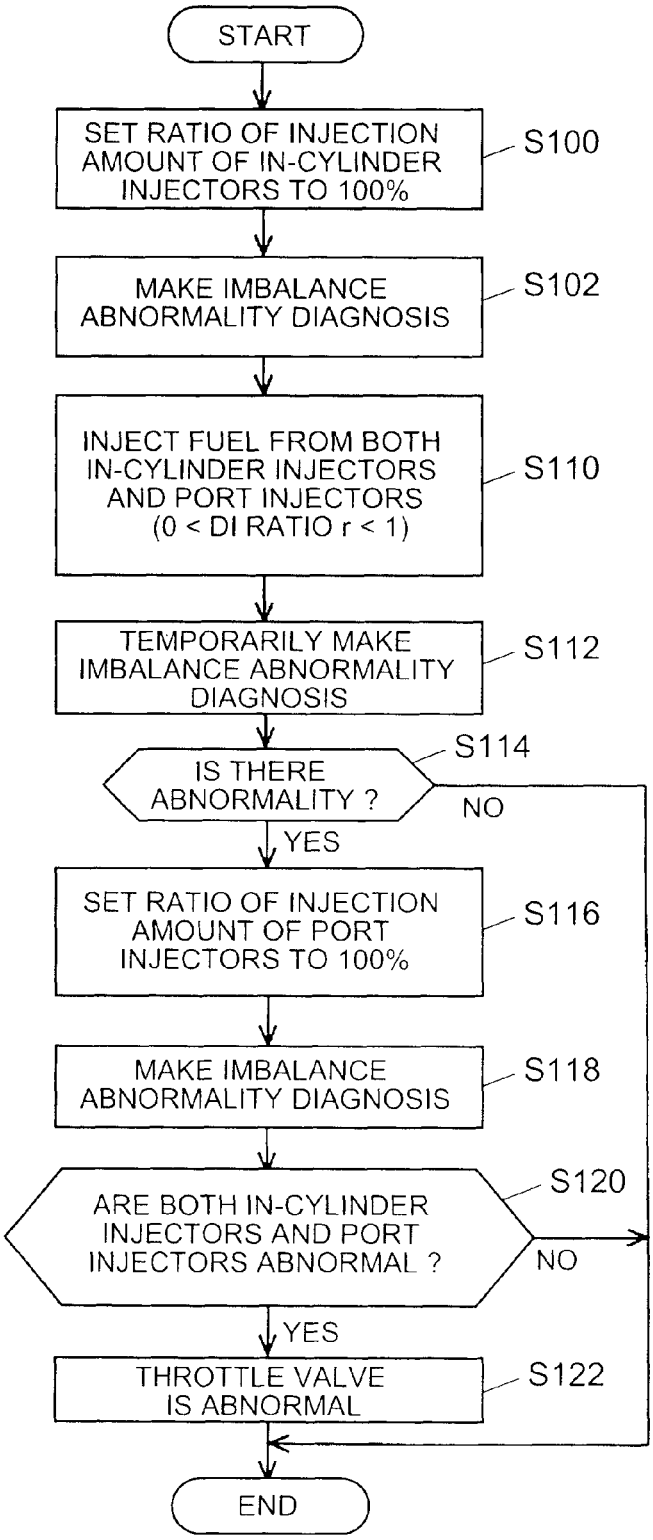
FIG. 5 is a flowchart that shows a process that is executed by an ECU in the first embodiment.

A process that is executed by the ECU 1000 in order to make an abnormality diagnosis in the present embodiment will be described with reference to FIG. 5. The process described below may be implemented by software, may be implemented by hardware or may be implemented by a cooperation of software and hardware. The process described below is executed when a predetermined condition selectively set by a developer is satisfied.

In step S100, the engine 100 is operated by injecting fuel from only the in-cylinder injectors 108. That is, the ratio of the injection amount of the in-cylinder injectors 108 with respect to the total injection amount is set to 100% (DI ratio r=1). In this operating situation, in step S102, it is diagnosed whether there is an imbalance abnormality in air-fuel ratio. That is, it is diagnosed whether there is an abnormality of the air-fuel ratio due to the in-cylinder injectors 108. When an abnormality has been detected, data that indicate that an abnormality has been detected and abnormal portions (here, the in-cylinder injectors 108) are stored in the memory of the ECU 1000.

After it has been diagnosed whether there is, an abnormality of the air-fuel ratio due to the in-cylinder injectors 108, it is diagnosed whether there is an abnormality of the air-fuel ratio due to the port injectors 109 irrespective of whether there is an abnormality of the air-fuel ratio due to the in-cylinder injectors 108. At the time of diagnosing whether there is an abnormality of the air-fuel ratio due to the port injectors 109, fuel is injected from both the in-cylinder injectors 108 and the port injectors 109 in step S110 (0<DI ratio r<1). At this time, the pressure of fuel that is injected from the in-cylinder injectors 108 is decreased. As an example, the pressure of fuel that is injected from the in-cylinder injectors 108 is decreased as compared to a pressure that is set in an operating situation in which it is not diagnosed whether there is an abnormality of the air-fuel ratio due to the in-cylinder injectors 108 or whether there is an abnormality of the air-fuel ratio due to the port injectors 109. For example, by decreasing the pressure of fuel that is supplied from the high-pressure fuel pump 107 to the in-cylinder injectors 108, the pressure of fuel that is injected from the in-cylinder injectors 108 is decreased.

In addition to decreasing the pressure of fuel that is injected from the in-cylinder injectors 108, the DI ratio r is decreased. As an example, the DI ratio r is decreased as compared to the DI ratio r that is set in the operating situation in which it is not diagnosed whether there is an abnormality of the air-fuel ratio due to the in-cylinder injectors 108 or whether there is an abnormality of the air-fuel ratio due to the port injectors 109. Thus, the ratio of the injection amount of the port injectors 109 is increased.

In this operating situation, it is temporarily diagnosed in step S112 whether there is an imbalance abnormality of the air-fuel ratio. That is, it is temporarily diagnosed whether there is an abnormality of the air-fuel ratio due to the port injectors 109. At the time of making an abnormality diagnosis of the air-fuel ratio due to the port injectors 109, by decreasing the pressure of fuel that is injected from the in-cylinder injectors 108, it is possible to reduce the fuel injection amount of the in-cylinder injectors 108 while keeping the fuel injection duration of the in-cylinder injectors 108 longer than a lower limit. It is possible to increase the ratio of the injection amount of the port injectors 109 by the reduced fuel injection amount of the in-cylinder injectors 108. Therefore, it is possible to increase the accuracy of an abnormality diagnosis of the air-fuel ratio due to the port injectors 109 by reducing the influence of the in-cylinder injectors 108 on abnormality diagnosis.

The amount of decrease in DI ratio r, that is, the amount of increase in the ratio of the injection amount of the port injectors 109, is changed on the basis of the result of an imbalance abnormality diagnosis of the air-fuel ratio due to the in-cylinder injectors 109.

As an example, when there is an imbalance abnormality of the air-fuel ratio due to the in-cylinder injectors 108, the DI ratio r is further decreased as compared to when there is no imbalance abnormality. Thus, although a certain amount of deposit that adheres to the abnormal in-cylinder injectors 108 is allowed, it is possible to reduce the influence of the in-cylinder injectors 108 on abnormality diagnosis. Therefore, it is possible to make an abnormality diagnosis of the port injectors 109 with high accuracy.

When there is no imbalance abnormality of the air-fuel ratio due to the in-cylinder injectors 108, the DI ratio r may be increased as compared to when there is an imbalance abnormality. That is, the ratio of the injection amount of the port injectors 109 may be reduced.

When an imbalance abnormality due to the port injectors 109 has been detected (YES in step S114), the ratio of the injection amount of the port injectors 109 is further increased in step S116. Specifically, the DI ratio r is set to "0". That is, the ratio of the injection amount of the port injectors 109 with respect to the total injection amount is set to 100%. The ratio of the injection amount of the port injectors 109 with respect to the total injection amount may be lower than 100%.

After the ratio of the injection amount of the port injectors 109 has been increased, an imbalance abnormality diagnosis of the air-fuel ratio, that is, an abnormality diagnosis of the air-fuel ratio due to the port injectors 109, is made in step S118. When an abnormality has been detected, data that indicate that an abnormality has been detected and abnormal portions (here, the port injectors 109) are stored in the memory of the ECU 1000.

In this way, in the present embodiment, the ratio of the injection amount of the port injectors 109 is increased in a stepwise manner, so the ratio of the injection amount of the in-cylinder injectors 108 is reduced in a stepwise manner. Therefore, at the time of making an imbalance abnormality diagnosis of the air-fuel ratio due to the port injectors 109, it is possible to make it difficult for a deposit to adhere to the in-cylinder injectors 108.

After an abnormality of the in-cylinder injectors 108 and the port injectors 109 has been detected, it is determined in step S120 whether both the in-cylinder injectors 108 and the port injectors 109 are abnormal. When both the in-cylinder injectors 108 and the port injectors 109 are abnormal, it is diagnosed in step S122 that there is an abnormality in distribution of air among the cylinders. As an example, it is recognized that a deposit is accumulated in an intake system, and it is diagnosed that the intake system is abnormal.

As described above, in the present embodiment, an abnormality diagnosis of the air-fuel ratio due to the in-cylinder injectors 108 is made in the operating situation in which fuel is injected from only the in-cylinder injectors 108, so it is possible to accurately make an abnormality diagnosis of the in-cylinder injectors 108. Furthermore, irrespective of whether there is an abnormality in the in-cylinder injectors 108, after an abnormality diagnosis of the air-fuel ratio due to the in-cylinder injectors 108 has been made, an abnormality diagnosis of the air-fuel ratio due to the port injectors 109 is made. Thus, it is possible to individually make an abnormality diagnosis of the in-cylinder injectors 108 and an abnormality diagnosis of the port injectors 109. The port injectors 109 are subjected to abnormality diagnosis in not only the operating situation in which fuel is injected from both the in-cylinder injectors 108 and the port injectors 109 but also the operating situation in which the ratio of the injection amount of the port injectors 109 is increased, so it is possible to make an abnormality diagnosis with high accuracy. Thus, it is possible to individually make an abnormality diagnosis of the in-cylinder injectors 108 and an abnormality diagnosis of the port injectors 109 with high accuracy.

Next, a second embodiment will be described. The present embodiment differs from the first embodiment in that, when there is an imbalance abnormality of the air-fuel ratio due to the in-cylinder injectors 108, an imbalance abnormality diagnosis is not made in a state where fuel is injected from both the in-cylinder injectors 108 and the port injectors 109. In the present embodiment, the DI ratio r is decreased to 0%, that is, the ratio of the injection amount of the port injectors 109 is increased to 100%, and an abnormality diagnosis of the air-fuel ratio due to the port injectors 109 is made. The other configuration is the same as that of the first embodiment. Thus, the detailed description thereof is not repeated here.

Figure 6:
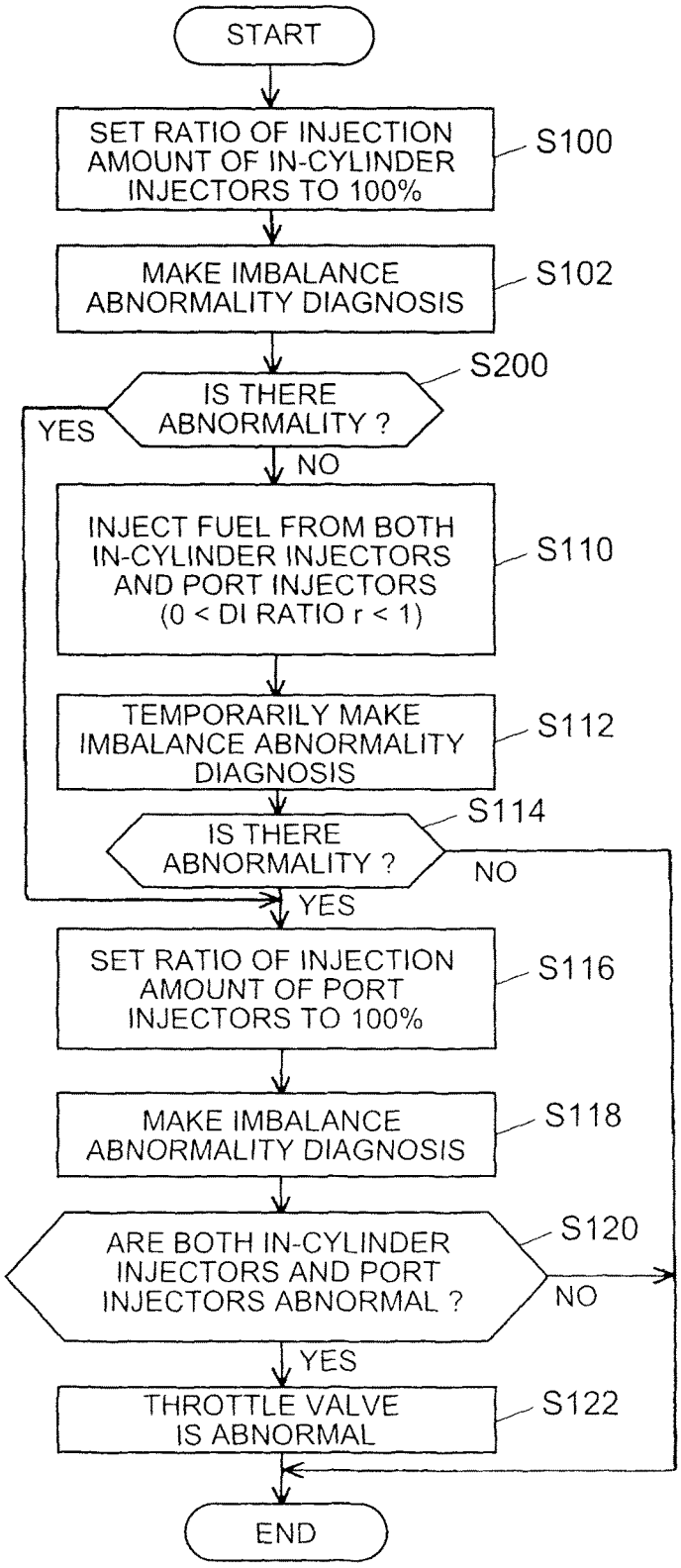
FIG. 6 is a flowchart that shows a process that is executed by the ECU in a second embodiment.

A process that is executed by the ECU 1000 in order to make an abnormality diagnosis in the present embodiment will be described with reference to FIG. 6. The process described below may be implemented by software, may be implemented by hardware or may be implemented by a cooperation of software and hardware. The process described below is executed when a predetermined condition selectively set by a developer is satisfied. Like reference numerals denote the like processes as those in the above-described first embodiment, and the detailed description thereof is not repeated.

In the present embodiment, after it has been diagnosed in step S102 whether there is an abnormality of the air-fuel ratio due to the in-cylinder injectors 108, it is determined in step S200 whether an imbalance abnormality of the air-fuel ratio due to the in-cylinder injectors 108 has been detected. When an imbalance abnormality of the air-fuel ratio due to the in-cylinder injectors 108 has not been detected (NO in step S200), fuel is injected from both the in-cylinder injectors 108 and the port injectors 109 in step S110 ($0<$DI ratio $r<1$).

On the other hand, when an imbalance abnormality of the air-fuel ratio due to the in-cylinder injectors 108 has been detected (YES in step S200), the DI ratio r is set "0" in step S116. That is, the ratio of the injection amount of the port injectors 109 with respect to the total injection amount is set to 100%.

With this configuration, although adhesion of a deposit to the abnormal in-cylinder injectors 108 is allowed, it is possible to exclude the influence of the in-cylinder injectors 108 on abnormality diagnosis. Therefore, it is possible to make an abnormality diagnosis of the port injectors 109 with high accuracy.

The above-described embodiments are illustrative and not restrictive in all respects. The scope of the invention is defined by the appended claims. The scope of the invention is intended to encompass all modifications within the scope of the appended claims and equivalents thereof.

The invention claimed is:

1. A diagnostic system for carrying out a diagnosis of a difference in air-fuel ratio among a plurality of cylinders in an internal combustion engine that includes the plurality of cylinders, in-cylinder injectors that respectively inject fuel inside the corresponding cylinders and port injectors that respectively inject fuel outside the corresponding cylinders, the diagnostic system comprising:

an electronic control unit configured to receive signals from an air-fuel ratio sensor and make an in-cylinder injector abnormality diagnosis of an air-fuel ratio due to the in-cylinder injectors based on signals from the air-fuel ratio sensor and then to make a port injector abnormality diagnosis of the air-fuel ratio due to the port injectors based on signals from the air fuel ratio sensor, the electronic control unit being configured to execute a program stored in a memory to control the engine to inject fuel from the in-cylinder injectors and the port injectors, wherein the electronic control unit is configured to execute the program to:

inject fuel from only the in-cylinder injectors and make the in-cylinder injector abnormality diagnosis of the air-fuel ratio due to the in-cylinder injectors in an operating situation in which fuel is injected from only the in-cylinder injectors by determining whether there is an abnormality of the air-fuel ratio due to the in-cylinder injectors based on signals from the air-fuel ratio sensor, and inject fuel from both the in-cylinder injectors and the port injectors after making the in-cylinder injector abnormality diagnosis and then make the port injector abnormality diagnosis of the air-fuel ratio due to the port injectors, irrespective of whether an abnormality of the air-fuel ratio due to the in-cylinder injectors is detected, by increasing a ratio of an injection amount of the port injectors and determining whether there is an abnormality of the air-fuel ratio due to the port injectors based on signals from the air-fuel ratio sensor, the electronic control unit being configured to make a combined injector abnormality diagnosis of the air-fuel ratio when fuel is injected from both the in-cylinder injectors and the port injectors after making the in-cylinder injector abnormality diagnosis, wherein when the electronic control unit then has diagnosed that there is a combined injector abnormality when fuel is injected from both the in-cylinder injectors and the port injectors, the electronic control unit is configured to make the port injector abnormality diagnosis of the air-fuel ratio due to the port injectors by further increasing the ratio of the injection amount of the port injectors, and wherein the electronic control unit is configured to make the port injector abnormality diagnosis of the air-fuel ratio due to the port injectors by increasing the ratio of the injection amount of the port injectors to 100% when the electronic control unit determines that there is an in-cylinder injector abnormality of the air-fuel ratio due to the in-cylinder injectors.

2. The diagnostic system according to claim 1, wherein at the time when the electronic control unit makes the combined injector abnormality diagnosis of the air-fuel ratio in the operating situation in which fuel is injected from both the in-cylinder injectors and the port injectors, the electronic control unit is configured to change an amount of increase in the ratio of the injection amount of the port injectors on the basis of a result of the in-cylinder injector abnormality diagnosis of the air-fuel ratio due to the in-cylinder injectors.

3. The diagnostic system according to claim 1, wherein the electronic control unit is configured to decrease a pressure of fuel that is injected from the in-cylinder injectors when the electronic control unit makes the combined injector abnormality diagnosis of the air-fuel ratio in the operating situation in which fuel is injected from both the in-cylinder injectors and the port injectors.

4. The diagnostic system according to claim 1, wherein the electronic control unit is configured to increase the ratio of the injection amount of the port injectors and make a port injector abnormality diagnosis of the air-fuel ratio due to the port injectors in a stepwise fashion until the ratio of the injection amount of the port injectors is increased to 100% when the electronic control unit diagnoses that there is a combined injector abnormality of the air-fuel ratio in the operating situation in which fuel is injected from both the in-cylinder injectors and the port injectors.

5. The diagnostic system according to claim 1, wherein the electronic control unit is configured to determine that there is an air distribution abnormality in distribution of air among the cylinders when the electronic control unit detects both an in-cylinder injector abnormality of the air-fuel ratio due to the in-cylinder injectors and a port injector abnormality of the air-fuel ratio due to the port injectors.

6. A diagnostic method for carrying out a diagnosis of a difference in air-fuel ratio among a plurality of cylinders in an internal combustion engine that includes the plurality of cylinders, in-cylinder injectors that respectively inject fuel inside the corresponding cylinders and port injectors that respectively inject fuel outside the corresponding cylinders, the diagnostic method comprising:

injecting fuel from only the in-cylinder injectors;

making an in-cylinder abnormality diagnosis of an air-fuel ratio due to the in-cylinder injectors in an operating situation in which fuel is injected from only the in-cylinder injectors and determining whether there is an abnormality of the air-fuel ratio due to the in-cylinder injectors based on signals from the air-fuel ratio sensor;

injecting fuel from both the in-cylinder injectors and the port injectors after making the in-cylinder injector abnormality diagnosis and then making a port injector abnormality diagnosis of the air-fuel ratio due to the port injectors, irrespective of whether an abnormality of the air-fuel ratio due to the in-cylinder injectors is detected, by increasing a ratio of an injection amount of the port injectors and determining whether there is an abnormality of the air-fuel ratio due to the port injectors based on signals from the air-fuel ratio sensor;

making a combined injector abnormality diagnosis of the air-fuel ratio after making the in-cylinder injector abnormality diagnosis;

when the combined injector abnormality diagnosis of the air-fuel ratio has been made in an operating situation in which fuel is injected from both the in-cylinder injectors and the port injectors and then it has been diagnosed that there is a combined injector abnormality, making a port injector abnormality diagnosis of the air-fuel ratio due to the port injectors by increasing a ratio of an injection amount of the port injectors while injecting fuel from both the in-cylinder injectors and the port injectors; and making the port injector abnormality diagnosis of the air-fuel ratio due to the port injectors by increasing the ratio of the injection amount of the port injectors to 100% when there is an in-cylinder injector abnormality of the air-fuel ratio due to the in-cylinder injectors.

* * * * *